US010571183B2

(12) United States Patent
Cheng et al.

(10) Patent No.: US 10,571,183 B2
(45) Date of Patent: Feb. 25, 2020

(54) REFRIGERATOR AND BRANCHING AIR SUPPLY DEVICE FOR REFRIGERATOR

(71) Applicant: QINGDAO HAIER JOINT STOCK CO., LTD, Qingdao (CN)

(72) Inventors: Xueli Cheng, Qingdao (CN); Bin Fei, Qingdao (CN); Chunyang Li, Qingdao (CN); Haibo Tao, Qingdao (CN)

(73) Assignee: QINGDAO HAIER JOINT STOCK CO., LTD, Qingdao (CN)

( * ) Notice: Subject to any disclaimer, the term of this patent is extended or adjusted under 35 U.S.C. 154(b) by 0 days.

(21) Appl. No.: 16/083,365

(22) PCT Filed: Jun. 12, 2016

(86) PCT No.: PCT/CN2016/085457
§ 371 (c)(1),
(2) Date: Sep. 7, 2018

(87) PCT Pub. No.: WO2017/152530
PCT Pub. Date: Sep. 14, 2017

(65) Prior Publication Data

US 2019/0113267 A1 Apr. 18, 2019

(30) Foreign Application Priority Data

Mar. 9, 2016 (CN) ..... 2016 1 0134046

(51) Int. Cl.
*F25D 17/04* (2006.01)
*F25D 17/06* (2006.01)
(Continued)

(52) U.S. Cl.
CPC ..... *F25D 17/08* (2013.01); *F25D 11/02* (2013.01); *F25D 17/045* (2013.01); *F25D 17/062* (2013.01); *F25D 2317/063* (2013.01)

(58) Field of Classification Search
CPC ..... F25D 17/04; F25D 17/042; F25D 17/045; F25D 17/06; F25D 17/062; F25D 17/065;
(Continued)

(56) References Cited

U.S. PATENT DOCUMENTS 4,476,773 A * 10/1984 Fehr ..... B60H 1/00471 137/625.47
5,735,138 A 4/1998 Park et al.
(Continued)

FOREIGN PATENT DOCUMENTS

CN 1200472 A 12/1998
CN 1708664 A 12/2005
(Continued)

OTHER PUBLICATIONS

International Search Report and Written Opinion for corresponding International Application No. PCT/CN2016/085457, dated Nov. 30, 2016, 9 pages.
(Continued)

*Primary Examiner* — Frantz F Jules
*Assistant Examiner* — Erik Mendoza-Wilkenfel
(74) *Attorney, Agent, or Firm* — Alston & Bird LLP

(57) ABSTRACT

A refrigerator and a branching air supply device for the refrigerator. The multipath air supply device for the refrigerator comprises: a housing having an air inlet and a plurality of air outlets; an adjustment member rotatably disposed in the housing to completely or partially block or completely expose each air outlet at different rotation positions, thereby adjusting respective air outlet areas of the plurality of air outlets; a baffle rotatably mounted at the air inlet; and a linkage device configured to transfer the rotational motion of the adjustment member to the baffle, so that the baffle moves to open or close the air inlet. A refrigerator having the branching air supply device. When a storage
(Continued)

compartment does not need cold air, the air inlet of the branching air supply device can be completely closed to block an airflow passage for providing cold air for the storage compartment.

10 Claims, 7 Drawing Sheets

(51) Int. Cl.

| | |
|---|---|
| ***F25D 17/08*** | (2006.01) |
| ***B60H 1/00*** | (2006.01) |
| ***F16K 31/53*** | (2006.01) |
| ***F16K 31/54*** | (2006.01) |
| ***F16K 11/02*** | (2006.01) |
| ***F16K 11/07*** | (2006.01) |
| ***F25D 11/02*** | (2006.01) |

(58) Field of Classification Search
CPC ... F25D 17/067; F25D 17/08; B60H 1/00557; B60H 1/00685; B60H 1/00678; F16K 31/53; F16K 31/535; F16K 31/54; F16K 11/02; F16K 11/07; F16K 11/072; F16K 11/0743; F16K 11/0746; F16K 11/076
See application file for complete search history.

(56) References Cited

U.S. PATENT DOCUMENTS

| | | | | |
|---|---|---|---|---|
| 2010/0125365 | A1* | 5/2010 | Ahn | F25D 17/065 700/275 |
| 2010/0147003 | A1* | 6/2010 | Ueda | A23B 4/066 62/314 |

FOREIGN PATENT DOCUMENTS

| | | | |
|---|---|---|---|
| CN | 102692110 | A | 9/2012 |
| CN | 202973722 | U | 6/2013 |
| CN | 103261819 | A | 8/2013 |
| CN | 204923642 | U | 12/2015 |
| CN | 205002483 | U | 1/2016 |
| CN | 105650980 | A | 6/2016 |
| DE | 202007015310 | U1 | 11/2008 |
| EP | 2009376 | | 12/2008 |
| EP | 2789937 | A1 | 10/2014 |
| JP | H1151536 | A | 2/1999 |
| KR | 20000074702 | A | 12/2000 |
| KR | 101390448 | B1 | 8/2008 |
| KR | 20110083912 | A | 7/2011 |
| KR | 20110120417 | A | 11/2011 |
| WO | WO 2009069900 | A2 | 6/2009 |

OTHER PUBLICATIONS

Office Action and Search Report for corresponding Chinese Application No. 201610134046.1, dated Dec. 5, 2017, 5 pages.
Written Opinion of the International Searching Authority for corresponding International Application No. PCT/CN2016/085457, dated Dec. 16, 2016, 4 pages.
International Preliminary Report on Patentability for corresponding International Application No. PCT/CN2016/085457, dated Sep. 11, 2018, 5 pages.

* cited by examiner

REFRIGERATOR AND BRANCHING AIR SUPPLY DEVICE FOR REFRIGERATOR

CROSS-REFERENCE TO RELATED APPLICATIONS

This application is a national phase entry of International Application No. PCT/CN2016/085457, filed Jun. 12, 2016, which claims priority to Chinese Patent Application No. 201610134046.1, filed on Mar. 9, 2016, the entire contents of which are incorporated herein by reference.

TECHNICAL FIELD

The Invention relates to the field of refrigerators, and in particular, to a refrigerator and a branching air supply device for a refrigerator.

BACKGROUND OF THE INVENTION

Generally, a built-in evaporator is used to generate cold air in an air-cooled refrigerator. The cold air circulates through an air duct to various storage compartments of the refrigerator to implement refrigeration. The performance of preserving food freshness of the air-cooled refrigerator greatly depends on whether air flow circulation is appropriate in the storage compartments. If the cold air flows randomly along the air duct, the amount of air that enters each storage compartment tends to be excessive or insufficient, resulting in uneven temperature distribution in the storage compartments and reduced running efficiency of the refrigerator. Therefore, it is necessary to perform precise flow direction distribution and flow rate control on cold air that enters the storage compartments.

Similarly, in order to optimize storage spaces, a single storage compartment may generally be separated into a plurality of subdivided storage spaces by shelving devices such as shelves or drawers, and according to the amount of stored articles, the refrigerating capacity required for each of the storage spaces also varies. Therefore, cold air directly entering the storage compartment from a certain place of the storage compartment without control may cause the problem that some of the storage spaces are overcooled and some suffer from insufficient refrigerating capacity.

For this, a branching air supply device is disposed at an air duct in the back of a box of a refrigerator in the prior art. An air inlet of the branching air supply device is connected to a cold air inlet, a plurality of air outlets of the branching air supply device are respectively connected to a plurality of cold air outlets of various storage compartments, and a control apparatus (for example, an electrical air damper) is disposed at the air duct to control the cold air inlet and the cold air outlets to be opened or closed. However, when this branching air supply device is turned off, the electrical air damper of the branching air supply device cannot be completely closed because of an angle. As a result, a storage compartment is overcooled, and the energy consumption of the refrigerator is increased. The use of the electrical air damper contributes to the structural complexity of the branching air supply device and increases the power consumption of the refrigerator.

SUMMARY OF THE INVENTION

In view of the above-mentioned problems, the Invention is proposed to provide a refrigerator and a branching air supply device for a refrigerator, which overcome the above-mentioned problems or at least partially solve the above-mentioned problems.

One objective of the Invention is to block an air flow passage that provides refrigerating capacity to a storage compartment when the storage compartment does not need refrigerating capacity, so as to prevent the storage compartment from being overcooled.

One further objective of the Invention is to simplify the structure and control manner of a branching air supply device.

Specifically, the Invention provides a branching air supply device for a refrigerator, comprising:

a housing, having an air inlet and a plurality of air outlets; and an adjustment member, rotatably disposed in the housing, to completely block, partially block or completely expose each air outlet in different rotational positions, so as to adjust respective air outlet areas of the plurality of air outlets;

a baffle, rotatably mounted at the air inlet; and a linkage apparatus, configured to transfer the rotational movement of the adjustment member to the baffle, so that the baffle moves to open or close the air inlet.

Optionally, the adjustment member comprises a rotary disk, and the adjustment member is rotatably disposed in the housing around an axis of the rotary disk.

Optionally, the linkage apparatus comprises a transmission lever and a gear mounted at the baffle, the transmission lever has gear teeth meshed with the gear, and the transmission lever is configured to be driven by the rotary disk to move in a length direction of the transmission lever, to drive the baffle to rotate.

Optionally, a slide groove is opened on one side surface of the rotary disk, the transmission lever extends in a radial direction of the rotary disk, and a bump for being inserted in the slide groove is provided at an end of the transmission lever.

Optionally, the slide groove comprises: a first slide groove section, having an arc shape that is concentric with the rotary disk; and a second slide groove section, extending from one end of the first slide groove section to a radial inner side of the other end of the first slide groove section.

Optionally, the housing comprises: a base; and a circumferential wall, extending from the base to a side of the base and coaxially disposed with the iii rotary disk, and the plurality of air outlets being formed on the circumferential wall, wherein the adjustment member further comprises one or more blocking plates disposed at an interval in a circumferential direction of the rotary disk, each blocking plate extends out from the other side surface of the rotary disk, and the one or more blocking plates are configured to completely block, partially block or completely expose each air outlet in different rotational positions.

Optionally, the projection of the circumferential wall on the base is arc-shaped; and the housing further comprises two air duct walls, disposed on the base and respectively extending out from two ends of the circumferential wall in a circumferential direction of the base, so that the air inlet is defined by ends, far away from the circumferential wall, of the two air duct walls.

Optionally, the rotary disk is disposed at an end, far away from the base, of the circumferential wall.

Optionally, three air outlets are provided sequentially at an interval in the circumferential direction of the base; two blocking plates are provided, the two blocking plates are respectively a first blocking plate and a second blocking plate; the first blocking plate is configured in a way that the first blocking plate is allowed to completely block one of the air outlets; the second blocking plate is configured in a way that the second blocking plate is allowed to completely block two of the air outlets; and an interval between the first blocking plate and the second blocking plate is configured in a way that the interval is allowed to completely expose one of the air outlets.

Specifically, the Invention further provides a refrigerator, comprising: an air duct component, comprising a cold air inlet and a plurality of cold air outlets, wherein the plurality of cold air outlets are respectively connected to a plurality of storage compartments of the refrigerator, or are connected to a storage compartment of the refrigerator through a plurality of connecting openings that are located in different positions on a compartment wall of the storage compartment; and a branching air supply device, disposed in the air duct component, wherein an air inlet of the branching air supply device is connected to the cold air inlet, and a plurality of air outlets of the branching air supply device are respectively connected to the plurality of cold air outlets of the air duct component.

In the branching air supply device and the refrigerator of the Invention, because the baffle is rotatably mounted at the air inlet, when the storage compartment does not need refrigerating capacity, the air inlet of the branching air supply device can be completely closed, so that the air flow passage that provides refrigerating capacity to the storage compartment can be blocked, to prevent the storage compartment from being overcooled to affect the use by a user, and the energy consumption can be reduced. Specifically, the linkage apparatus is mounted between the adjustment member and the baffle, so that an adjuster can drive the baffle to rotate to control the air inlet to be opened or closed. Specifically, the rotation of the adjustment member not only controls the air outlets to be opened or closed, but also controls the air inlet to be opened or closed, so that the control of the branching air supply device is simpler and more precise.

Further, the linkage apparatus in the branching air supply device of the Invention comprises the transmission lever having the gear teeth and the gear mounted at the baffle, and the transmission lever is driven by the rotary disk to drive the baffle to rotate, so that the air inlet is opened or closed. In this linkage manner, the structure of the branching air supply device can be compact, simple, and have particularly wide applicability.

Further, the slide groove on the rotary disk in the branching air supply device of the Invention and the bump on the transmission lever drive the transmission lever to move. The principle of a cam mechanism is cleverly used, so that the driving manner is simple, convenient, and precise, and the structure of the branching air supply device is compact and simple.

According to the detailed description of specific embodiments of the Invention below in conjunction with the accompanying drawings, the above and other objectives, advantages and features will become more apparent to a person skilled in the art.

BRIEF DESCRIPTION OF THE DRAWINGS

Some of specific embodiments of the invention will be described below in detail with reference to the accompanying drawings by way of example but not by way of limitation. The same reference signs indicate the same or similar components or parts in the accompanying drawings. A person skilled in the art should understand that these figures are not necessarily drawn to scale. In the accompanying drawings.

and

Figure 2:
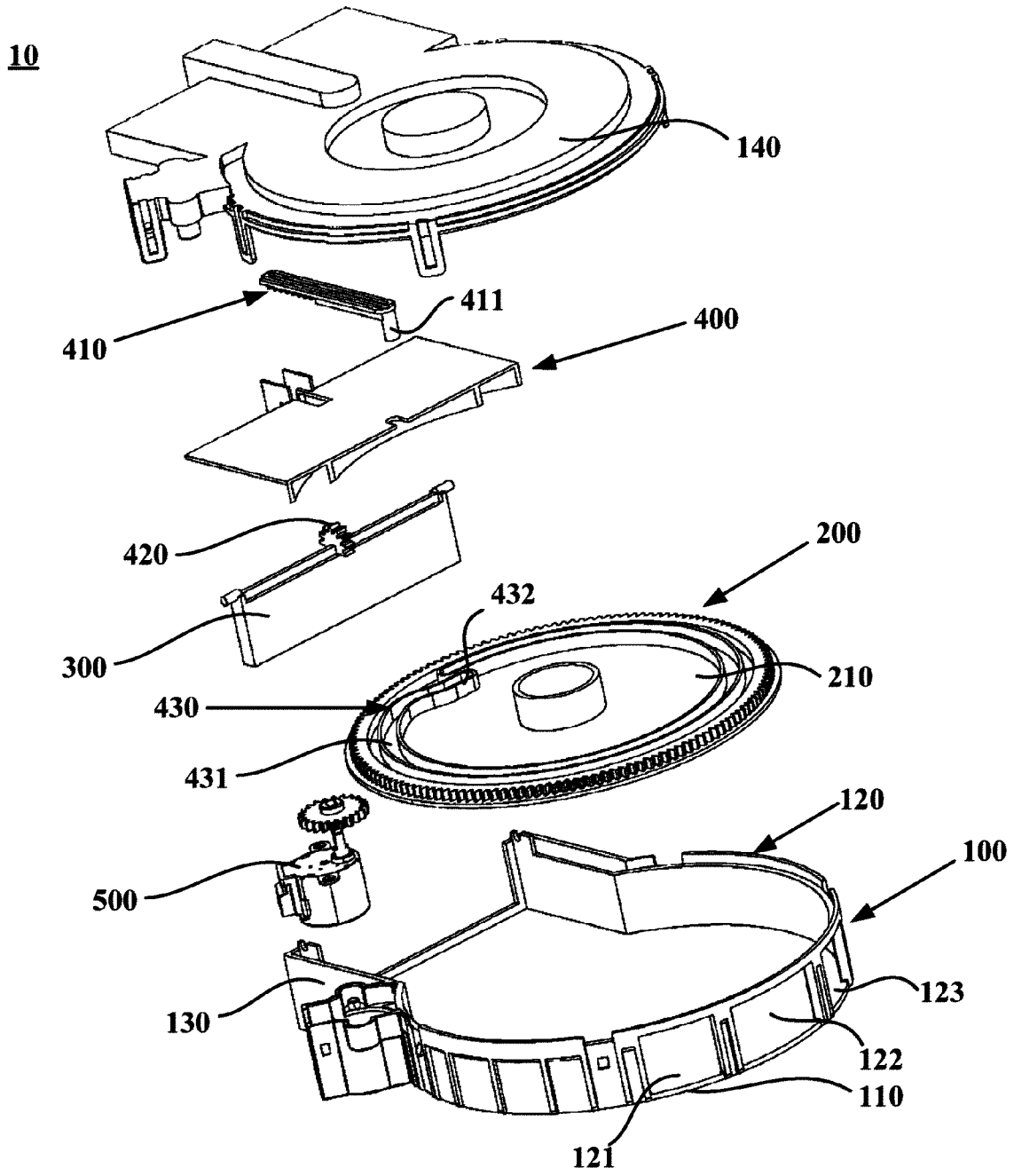
FIG. 2 is a schematic exploded view of the branching air supply device shown in FIG. 1.
Figure 8:
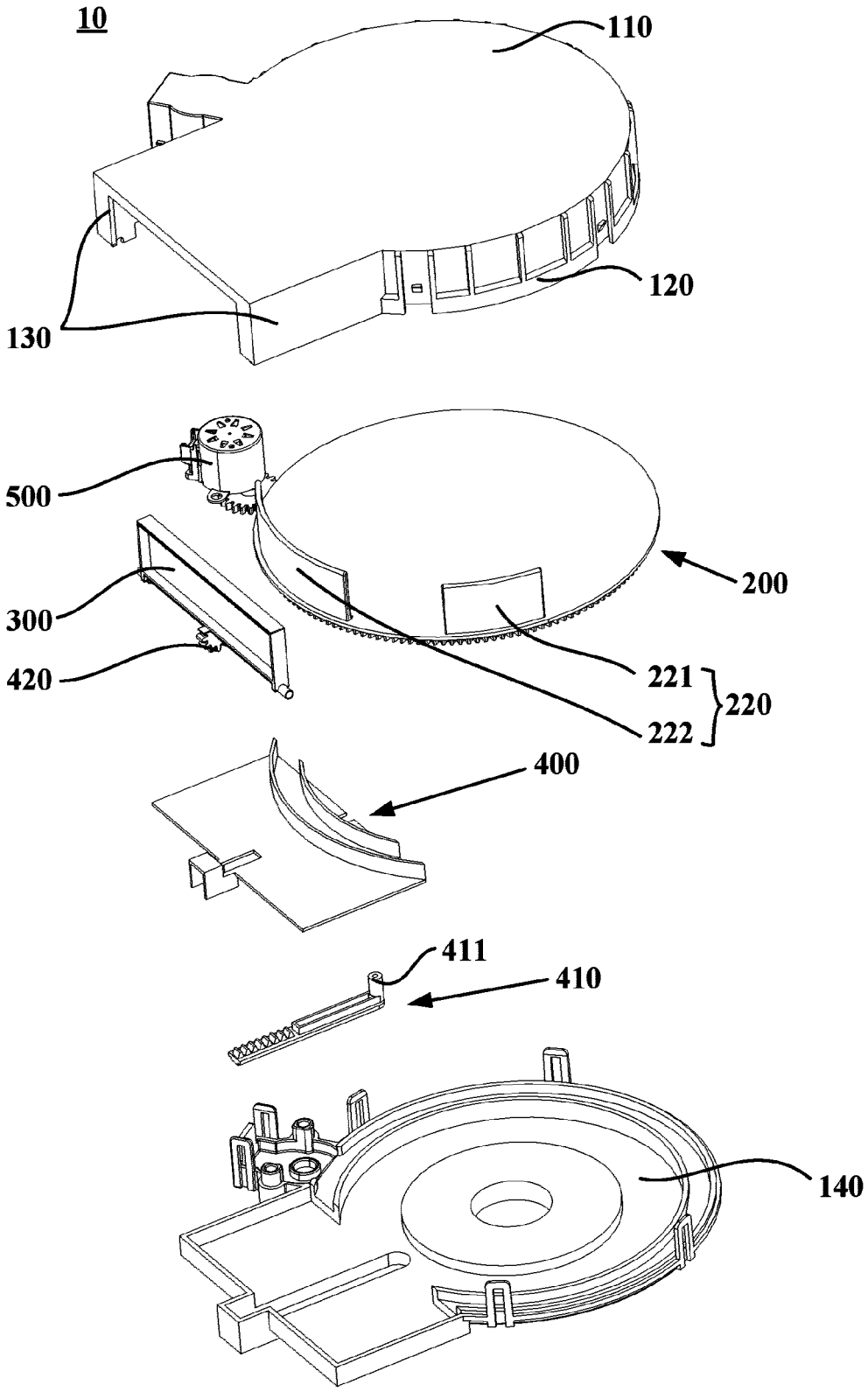

FIG. 8 is a schematic exploded view of the branching air supply device shown in FIG. 2 from another perspective.

DETAILED DESCRIPTION OF THE INVENTION

Figure 1:
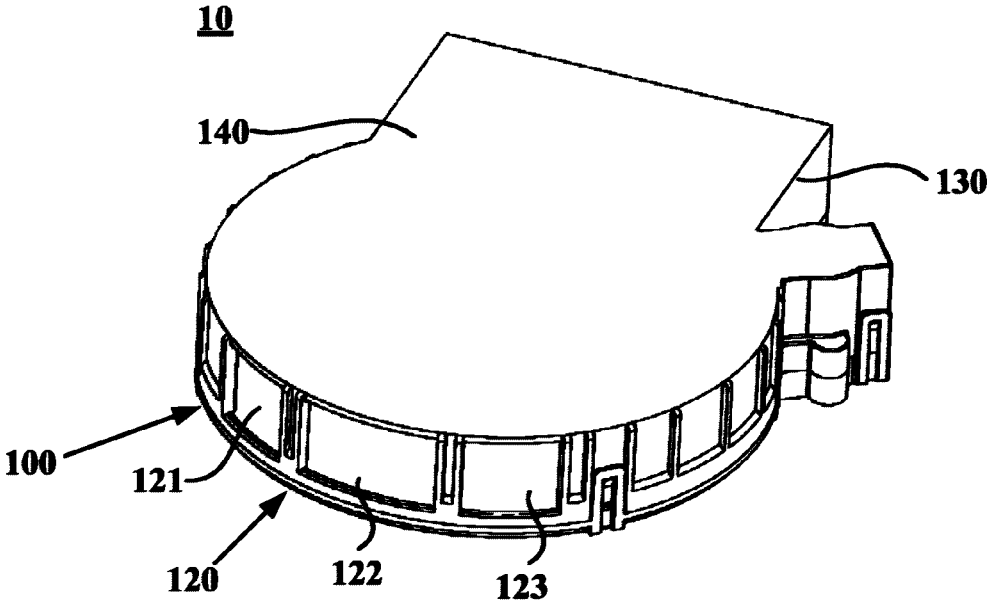
FIG. 1 is a schematic structural diagram of a branching air supply device according to an embodiment of the Invention.

FIG. 1 is a schematic structural diagram of a branching air supply device 10 according to an embodiment of the Invention. FIG. 2 is a schematic exploded view of the branching air supply device 10 shown in FIG. 1. FIG. 8 is a schematic exploded view of the branching air supply device 10 shown in FIG. 2 from another perspective. As shown in FIG. 1, FIG. 2, and FIG. 8, the branching air supply device 10 for a refrigerator 1 provided in this embodiment may comprise a housing 100, an adjustment member 200, a baffle 300, and a linkage apparatus 400.

The housing 100 may have an air inlet and a plurality of air outlets, so that cold air produced by an evaporator may enter the housing 100 of the branching air supply device 10 through the air inlet, and may flow out from the plurality of air outlets, to eventually flow to a plurality of storage compartments of the refrigerator 1 or flow into a storage compartment from a plurality of positions of the storage compartment.

The adjustment member 200 is rotatably disposed in the housing 100, to completely block, partially block or completely expose each air outlet in different rotational positions, so as to adjust respective air outlet areas of the plurality of air outlets. Cold air that enters each storage compartment or cold air that enters each position of a storage compartment can further be precisely distributed, and the refrigeration performance of the refrigerator 1 is improved.

The baffle 300 is rotatably mounted at the air inlet, so as to completely close the air inlet of the branching air supply device 10 when the branching air supply device 10 needs to be closed, so that a cold air flow can be prevented from entering a storage compartment through the branching air supply device 10, so as to further prevent the storage compartment from being overcooled to affect the use by a user, and the energy consumption can be reduced.

The linkage apparatus 400 may be configured to transfer the rotational movement of the adjustment member 200 to the baffle 300, to drive the baffle 300 to open or close the air inlet, so that the rotation of the adjustment member 200 can not only control an air outlet to be opened or closed, but also control the air inlet to be opened or closed. Not only the air inlet and the air outlet are controlled in a more coordinated manner, but also the control of the branching air supply device 10 can be simpler and more precise.

In some embodiments of the Invention, the adjustment member 200 may comprise a rotary disk 210. Specifically, the rotary disk 210 may be circular, and the adjustment member 200 is rotatably disposed in the housing 100 around an axis of the rotary disk 210. Further, gear teeth may be further disposed at an outer edge of the rotary disk 210, and a motor 500 is mounted on the housing 100. A gear mounted on an output shaft of the motor 500 is meshed with the gear teeth at the outer edge of the rotary disk 210 to drive the rotary disk 210 to rotate.

In some embodiments of the Invention, the linkage apparatus 400 may comprise a transmission lever 410 and a gear 420 mounted on the baffle 300. Specifically, gear teeth meshed with the gear 420 on the baffle 300 are provided on the transmission lever 410, and the transmission lever 410 is configured to be driven by the rotary disk 210 to move in a length direction of the transmission lever 410, to drive the baffle 300 to rotate. In some alternative embodiments, the linkage apparatus 400 may comprise two connecting rods. One end of one connecting rod is pivotally connected to a side, far away from a rotating shaft of the baffle 300, from the baffle 300. The other end of one connecting rod is pivotally connected to one end of the other connecting rod. The other end of the other connecting rod is configured to be driven by the rotary disk 210 to move in a length direction of the connecting rod, so as to drive the baffle 300 to rotate. A gear structure is not needed in this implementation manner, and the structure is simple.

In some embodiments of the Invention, a slide groove 430 may be provided on one side surface of the rotary disk 210, the transmission lever 410 extends in a radial direction of the rotary disk 210, and a bump 411 for being inserted in the slide groove 430 is further provided at an end of the transmission lever 410, so that when the rotary disk 210 rotates, the bump 411 slides in the slide groove 430 and moves in the length direction of the transmission lever 410 under the effect of the slide groove 430, so as to drive the transmission lever 410 to move and further cause the baffle 300 to rotate.

In some implementation manners of the embodiment, the slide groove 430 comprises a first slide groove section 431 and a second slide groove section 432 connected to the first slide groove section 431. Specifically, the first slide groove section 431 is used as a main part of the slide groove 430, and has an arc shape that is concentric with the rotary disk 210. The second slide groove section 432 extends from one end of the first slide groove section 431 to a radial inner side of the other end of the first slide groove section 431. In this way, when the adjustment member 200 adjusts an air outlet area of each air outlet, by using the characteristic of the first slide groove section 431, the movement of the bump 411 is not caused, and the air inlet is not closed, so that the normal working of the branching air supply device 10 can be ensured. When the air inlet needs to be closed, by using the characteristic of the second slide groove section 432, the bump 411 pulls the transmission lever 410 and actuates the baffle 300 to close the air inlet. Preferably, an angle between two connecting lines formed between two ends of the first slide groove section 431 and the center of the rotary disk 210 is 330°, and an angle between two connecting lines between two ends of the second slide groove section 432 and the center of the rotary disk 210 is 30°, to quantify a sliding process of the bump 411 in the slide groove 430. Further, the second slide groove section 432 may close the air inlet rapidly and does not easily cause damage to the linkage apparatus 400.

In some alternative implementation manners, the slide groove 430 may comprise a third slide groove section and a fourth slide groove section. The third slide groove section is used as a main part of the slide groove and has an arc shape that is concentric with the rotary disk 210. The fourth slide groove section extends in a direction from one end of the third slide groove section towards the center of the rotary disk 210 and then extends in a direction away from the center of the rotary disk 210 to the other end of the third slide groove section, so that a groove channel is a groove channel with head-to-end connection. In this implementation manner, the motor 500 does not need to reverse when an air outlet needs to be opened after the branching air supply device 10 closes the air inlet, so that the operations are facilitated, the structure is simple, and the processing is easy.

In some embodiments of the Invention, the housing 100 comprises a base 110, a circumferential wall 120, a housing cover 140, and two air duct walls 130. Specifically, the circumferential wall 120 extends from a partial edge of the base 110 to a side of the base 110 and is coaxially disposed with the rotary disk 210. A plurality of air outlets are formed on the circumferential wall 120. Moreover, the projection of the circumferential wall 120 on the base 110 is preferably arc-shaped. The two air duct walls 130 are disposed on the base 110 and respectively extend out from two ends of the circumferential wall 120 in a circumferential direction of the base 110, so that an air inlet duct of the branching air supply device 10 is defined by the two air duct walls 130, and the air inlet is defined by ends, far away from the circumferential wall 120, of the two air duct walls 130. The two air duct walls 130 may respectively extend in the length direction of the transmission lever 410 out from the two ends of the circumferential wall 120 in the circumferential direction of the base 110. Moreover, the rotary disk 210 is disposed at an end, far away from the base 110, of the circumferential wall 120. The housing cover 140 is mounted at ends, far away from the base 110, of the circumferential wall 120 and the air duct walls 130, and are clamped to the circumferential wall 120 and the air duct walls 130.

In this embodiment, the adjustment member 200 may further comprise one or more blocking plates 220 disposed at an interval in a circumferential direction of the rotary disk 210. Each blocking plate 220 extends out from the other side surface (that is, the side surface opposite the side surface on which the slide groove 430 is located) of the rotary disk 220, and the one or more blocking plates 220 are configured to completely block, partially block or completely expose each air outlet in different rotational positions, to controllably change air outlet areas of the air outlets, so as to implement precise flow direction distribution and flow rate control on cold air that enters the storage compartments.

For example, in this embodiment, three air outlets are provided sequentially at an interval in the circumferential direction of the base 110, and are respectively a first air outlet 121, a second air outlet 122, and a third air outlet 123. Two blocking plates 220 are provided, and the two blocking plates 220 are respectively a first blocking plate 221 and a second blocking plate 222. The first blocking plate 221 is configured in a way that the first blocking plate 221 is allowed to completely block one of the air outlets. The second blocking plate 222 is configured in a way that the second blocking plate 222 is allowed to completely block two of the air outlets. An interval between the first blocking plate 221 and the second blocking plate 222 is configured in a way that the interval is allowed to completely expose one of the air outlets.

When the first blocking plate 221 and the second blocking plate 222 rotate to block none of the three air outlets, the first air outlet 121, the second air outlet 122, and the third air outlet 123 may all be in an opened state. When the second blocking plate 222 rotates to completely block the second air outlet 122 and the third air outlet 123, the first air outlet 121 may be in a completely exposed state. When the first blocking plate 221 completely blocks the third air outlet 123 and the second blocking plate 222 completely blocks the first air outlet 121, the interval between the two blocking plates 220 may keep the second air outlet 122 in a completely exposed state. When the second blocking plate 222 completely blocks the first air outlet 121 and the second air outlet 122, the interval between the two blocking plates 220 may keep the third air outlet 123 in a completely exposed state.

When the second blocking plate 222 can completely block only the third air outlet 123, the first air outlet 121 and the second air outlet 122 are in a completely exposed state. When the first blocking plate 221 completely blocks the first air outlet 121, the second air outlet 122 and the third air outlet 123 are in a completely exposed state. When the first blocking plate 221 completely blocks the second air outlet 122, the third air outlet 123 is in a completely exposed state, and the interval between the two blocking plates 220 may keep the first air outlet 121 in a completely exposed state.

Certainly, the first blocking plate 221 and the second blocking plate 222 may alternatively rotate to rotational positions to block a half of the first air outlet 121 and keep the second air outlet 122 and the third air outlet 123 in a completely exposed state. For example, the first blocking plate 221 is in a position of only blocking a half, far away from the second air outlet 122, of the first air outlet 121. The first blocking plate 221 and the second blocking plate 222 may alternatively rotate to rotational positions of completely blocking the first air outlet 121, blocking a half of the second air outlet 122, and keeping the third air outlet 123 in a completely exposed state. For example, the second blocking plate 222 is in a position of completely blocking the first air outlet 121 and blocking a half, far away from the third air outlet 123, of the second air outlet 122.

Figure 3:
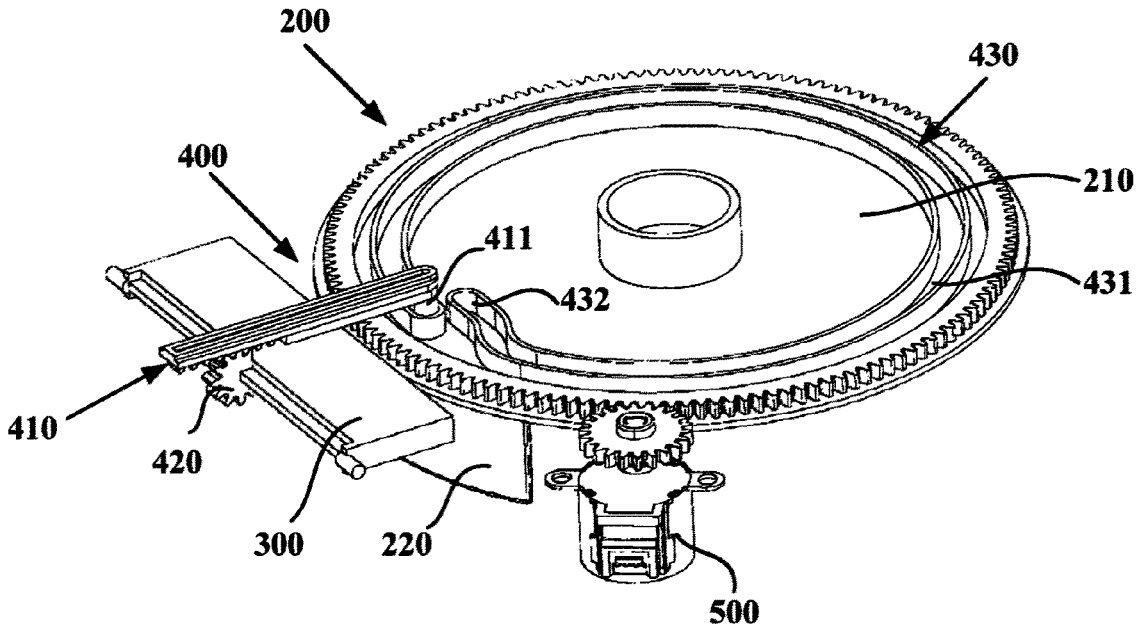
FIG. 3 is a schematic diagram of a first movement state of the branching air supply device shown in FIG. 1.
Figure 4:
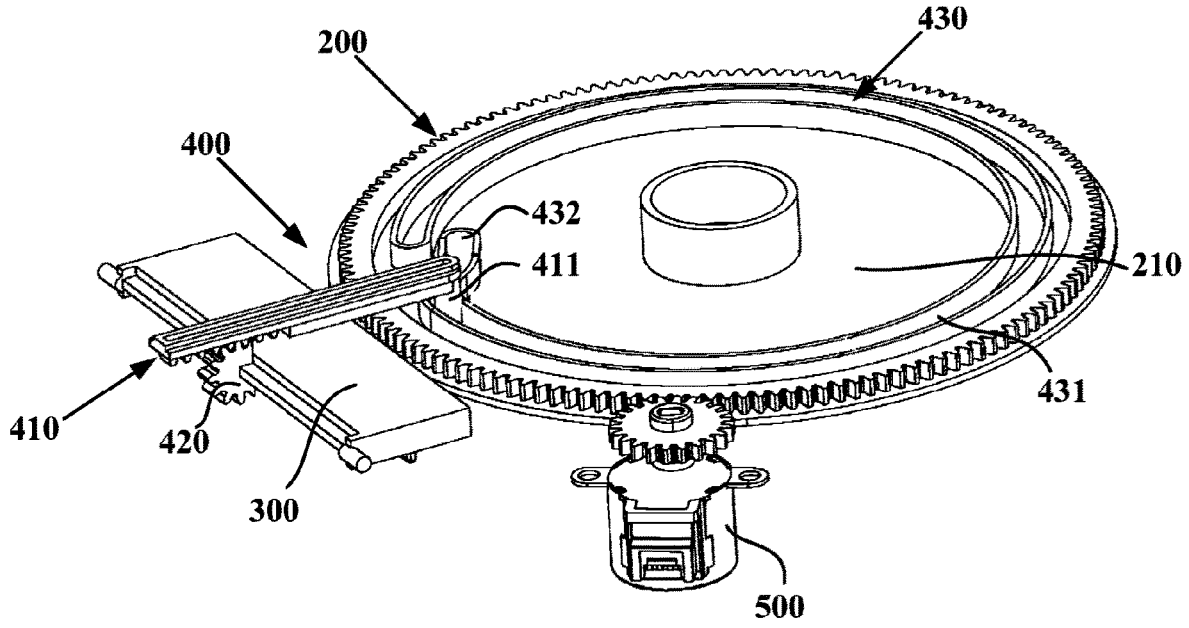
FIG. 4 is a schematic diagram of a second movement state of the branching air supply device shown in FIG. 1.
Figure 5:
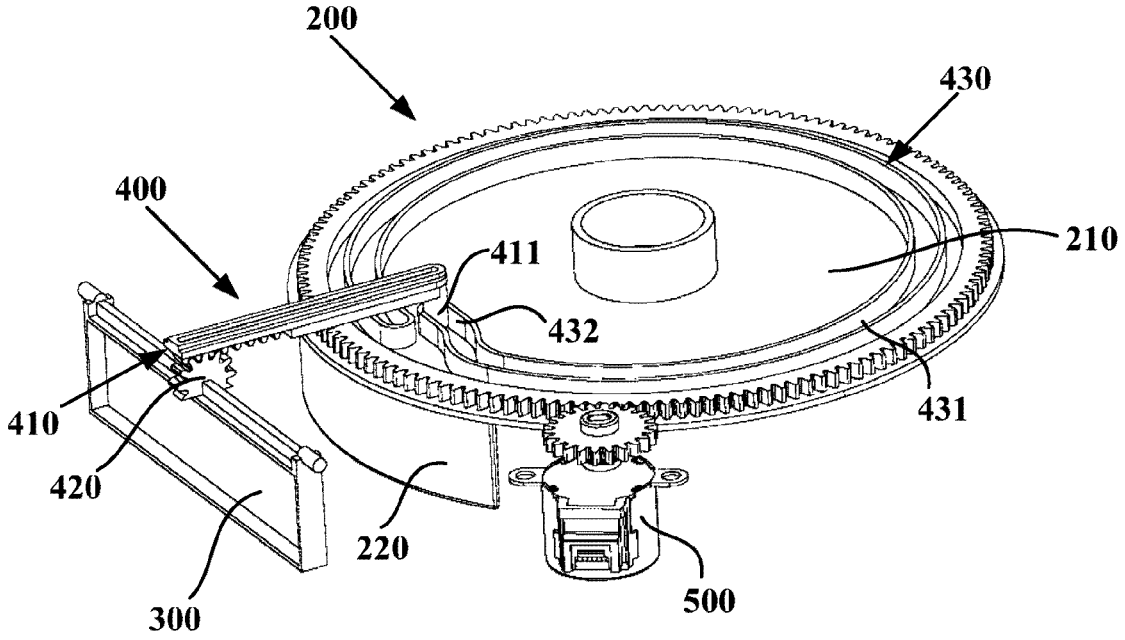
FIG. 5 is a schematic diagram of a third movement state of the branching air supply device shown in FIG. 1.

FIG. 3 to FIG. 5 are schematic diagrams of movement states of the branching air supply device for the refrigerator 1 in some embodiments of the Invention. As shown in FIG. 3, when the rotary disk 210 rotates and the bump 411 of the transmission lever 410 slides in the first slide groove section 431, the rotary disk 210 drives the blocking plate 220 to rotate to enable the blocking plate 220 to adjust air outlet areas of various air outlets. In this case, the baffle 300 keeps an opened state. As shown in FIG. 4, when the rotary disk 210 rotates and the bump 411 of the transmission lever 410 slides in the second slide groove section 432, that is, at this time, the branching air supply device 10 does not need to provide refrigerating capacity to a storage compartment, the bump 411 may drive the transmission lever 410 to move in the length direction of the transmission lever 410, and actuate the baffle 300 to rotate till the air inlet is closed. As shown in FIG. 5, when the rotary disk 210 stops rotating and the bump 411 of the transmission lever 410 is located in a stop position at an end of the second slide groove section 432, the branching air supply device 10 stops the air amount distribution work, and the transmission lever 410 actuates the baffle 300 to completely close the air inlet, so as to prevent cold air from entering through the air inlet to cause a storage compartment to be overcooled.

Figure 6:
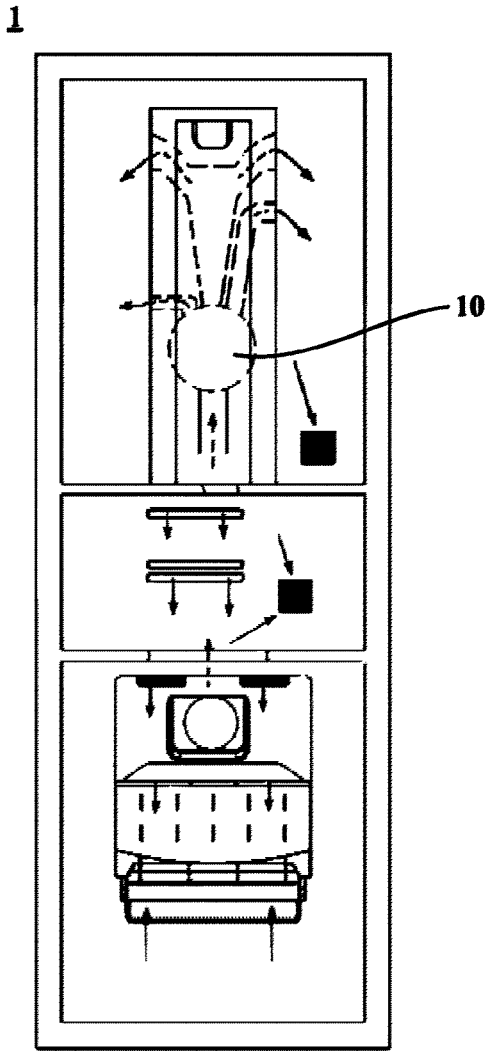
FIG. 6 is a schematic structural diagram of a refrigerator according to an embodiment of the Invention.
Figure 7:
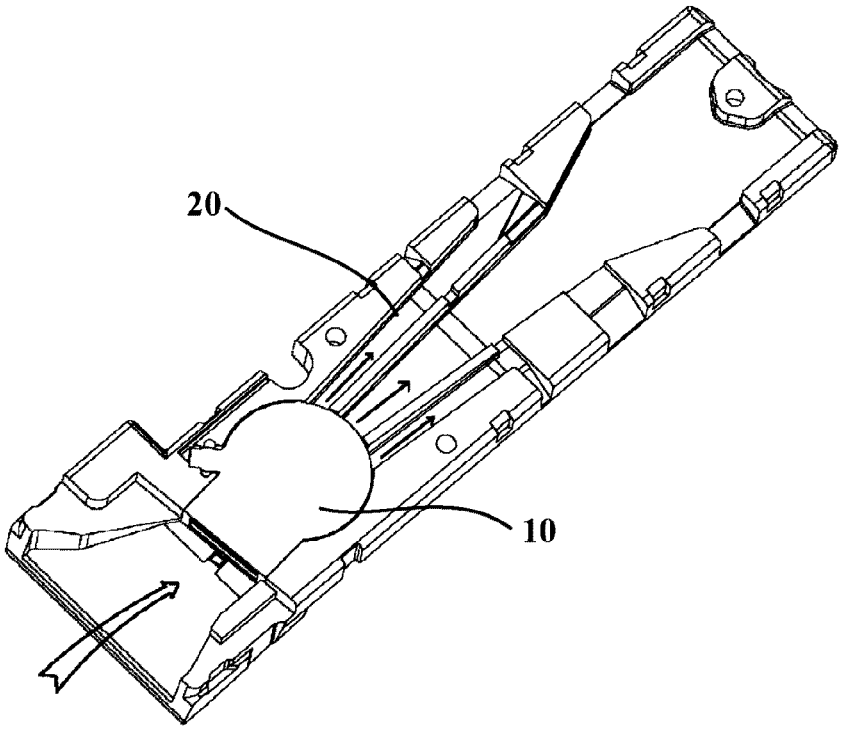
FIG. 7 is a schematic partial structural diagram of the refrigerator in FIG. 6.

FIG. 6 is a schematic structural diagram of a refrigerator 1 according to an embodiment of the Invention. FIG. 7 is a schematic partial structural diagram of the refrigerator 1 in FIG. 6. As shown in FIG. 6 and FIG. 7, the refrigerator 1 further provided in this embodiment of the Invention comprises an air duct component 20 and a branching air supply device 10. Specifically, the air duct component 20 comprises a cold air inlet and a plurality of cold air outlets. The plurality of cold air outlets are respectively connected to a plurality of storage compartments of the refrigerator 1, or are connected to a storage compartment of the refrigerator 1 through a plurality of connecting openings that are located in different positions on a compartment wall of the storage compartment. The branching air supply device 10 is disposed in the air duct component 20. An air inlet of the branching air supply device 10 is connected to the cold air inlet. A plurality of air outlets of the branching air supply device 10 are respectively connected to the plurality of cold air outlets of the air duct component 20.

In the refrigerator 1 in this embodiment, when supplying cold air to various positions in a storage compartment, the air duct component 20 may control, according to whether the refrigerating capacity in positions of the storage compartment is sufficient, the cold air to flow into the positions from corresponding air ducts, so that the cold air is reasonably distributed to different positions of the storage compartment, which increase the freshness preservation performance and running efficiency of the refrigerator 1. The branching air supply device 10 can implement the adjustment of the air direction and the air amount, so that in the storage compartment, a cold air outlet is opened where cold air is needed. Thus, the constancy of the temperature in the refrigerator 1 is controlled, an optimal storage environment is provided for food in the refrigerator 1, nutrition loss of food is reduced, power consumption of the refrigerator 1 can be reduced, and energy is saved.

Up to this, a person skilled in the art should recognize that although a plurality of exemplary embodiments of the Invention have been shown and described in detail herein, numerous other variations or modifications meeting the principle of the Invention can be directly determined or derived according to the contents disclosed in the Invention. Therefore, the scope of the Invention should be construed and considered as covering all of such other variations or modifications.

What is claimed is:

1. A branching air supply device for a refrigerator, comprising:

a housing, having an air inlet and a plurality of air outlets;

an adjustment member, rotatably disposed in the housing, the adjustment member configured to rotate to different rotational positions within the housing such that each air outlet of the plurality of air outlets is configured to be completely blocked, partially blocked or completely exposed at the different rotational positions of the adjustment member, so as to adjust respective air outlet areas of each of the plurality of air outlets;

a baffle, rotatably mounted at the air inlet; and a linkage apparatus, configured to transfer the rotational movement of the adjustment member to the baffle, so that the baffle moves to open or close the air inlet.

2. The branching air supply device according to claim 1, wherein the adjustment member comprises a rotary disk, and the adjustment member is rotatably disposed in the housing around an axis of the rotary disk.

3. The branching air supply device according to claim 2, wherein the linkage apparatus comprises a transmission lever and a gear mounted at the baffle, the transmission lever has gear teeth meshed with the gear, and the transmission lever is configured to be driven by the rotary disk to move in a length direction of the transmission lever, to drive the baffle to rotate.

4. The branching air supply device according to claim 3, wherein a slide groove is opened on one side surface of the rotary disk, the transmission lever extends in a radial direction of the rotary disk, and a bump for being inserted in the slide groove is provided at an end of the transmission lever.

5. The branching air supply device according to claim 4, wherein the slide groove comprises:

a first slide groove section, having an arc shape that is concentric with the rotary disk; and a second slide groove section, extending from one end of the first slide groove section to a radial inner side of the other end of the first slide groove section.

6. The branching air supply device according to claim 4, wherein the housing comprises:

a base; and a circumferential wall, extending from the base to a side of the base and coaxially disposed with the rotary disk, and the plurality of air outlets being formed on the circumferential wall;

wherein the adjustment member further comprises one or more blocking plates disposed at an interval in a circumferential direction of the rotary disk, each blocking plate extends out from the other side surface of the rotary disk, and the one or more blocking plates are configured to completely block, partially block or completely expose each air outlet in different rotational positions.

7. The branching air supply device according to claim 6, wherein the projection of the circumferential wall on the base is arc-shaped; and the housing further comprises two air duct walls, disposed on the base and respectively extending out from two ends of the circumferential wall in a circumferential direction of the base, so that the air inlet is defined by ends, far away from the circumferential wall, of the two air duct walls.

8. The branching air supply device according to claim 7, wherein the rotary disk is disposed at an end, far away from the base, of the circumferential wall.

9. The branching air supply device according to claim 8, wherein three air outlets are provided sequentially at an interval in the circumferential direction of the base;

two blocking plates are provided, and the two blocking plates are respectively a first blocking plate and a second blocking plate, and the first blocking plate is configured in a way that the first blocking plate is allowed to completely block one of the air outlets, the second blocking plate is configured in a way that the second blocking plate is allowed to completely block two of the air outlets, and an interval between the first blocking plate and the second blocking plate is configured in a way that the interval is allowed to completely expose one of the air outlets.

10. A refrigerator, comprising:

an air duct component, comprising a cold air inlet and a plurality of cold air outlets, wherein the plurality of cold air outlets are respectively connected to a plurality of storage compartments of the refrigerator, or are connected to a storage compartment of the refrigerator through a plurality of connecting openings that are located in different positions on a compartment wall of the storage compartment; and the branching air supply device according to claim 1, disposed in the air duct component, wherein an air inlet of the branching air supply device is connected to the cold air inlet, and a plurality of air outlets of the branching air supply device are respectively connected to the plurality of cold air outlets of the air duct component.

* * * * *